United States Patent [19]

Kellie et al.

[11] Patent Number: 4,708,739

[45] Date of Patent: Nov. 24, 1987

[54] GRAIN REFINING METALS

[75] Inventors: James L. F. Kellie; Andrew J. J. Cowell, both of Sheffield, England

[73] Assignee: London & Scandinavian Metallurgical Co. Limited, London, England

[21] Appl. No.: 912,227

[22] Filed: Sep. 29, 1986

[30] Foreign Application Priority Data

Oct. 4, 1985 [GB] United Kingdom ..... 8524531

[51] Int. Cl.[4] ..... C22B 15/00; B22F 1/00

[52] U.S. Cl. ..... 75/76; 75/251; 75/255; 420/469

[58] Field of Search ..... 75/76, 251, 255; 420/417–421, 422–423, 469

[56] References Cited

U.S. PATENT DOCUMENTS 2,766,113 10/1956 Chisholm ..... 420/418

2,892,742 6/1959 Zwicker ..... 420/418

*Primary Examiner*—Peter D. Rosenberg

*Attorney, Agent, or Firm*—L. S. Van Landingham, Jr.

[57] ABSTRACT

The invention provides a grain refinement method for copper-based metals, which method can be applied to a range of different types of such metals. In accordance with the method, one arranges that a melt of the metal to be grain refined contains each of the following components:

(a) titanium and/or zirconium;

(b) at least one of: lithium, sodium, potassium, beryllium, magnesium, calcium, strontium and barium;

(c) at least one of: scandium, yttrium, titanium, zirconium, hafnium, vanadium, niobium, tantalum, chromium, molybdenum, tungsten, manganese, technetium, rhenium, iron, ruthenium, osmium, cobalt, rhodium, iridium, nickel, palladium, platinum, silver, gold, zinc, cadmium, mercury and the rare earth elements; and (d) at least one of: aluminium, gallium, indium, silicon, germanium, tin, lead, phosphorus, arsenic, antimony, bismuth, sulphur, selenium and tellurium;

and solidifies the melt to produce grain refinement of the copper-based metal, at least one of components (a) to (d) being introduced into the melt by means of a powder which comprises one or more of the components (a) to (d). The invention also provides grain refiners for practicing the method.

30 Claims, 5 Drawing Figures

GRAIN REFINING METALS

Figure 1:
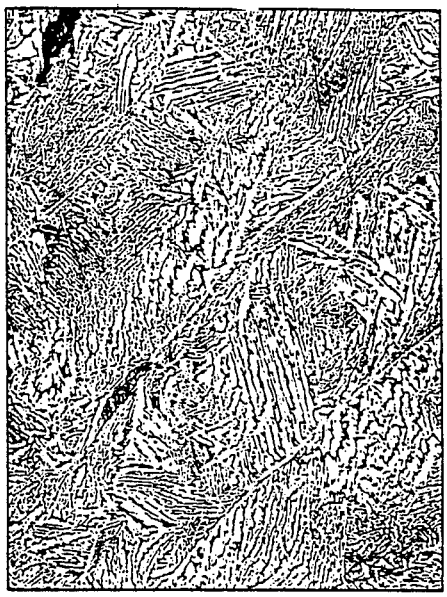

This invention relates to grain refining metals, and is more especially concerned with grain refining copper-based metals.

In our UK patent application No. 8521134, filed on Aug. 23, 1985, there are described and claimed a method of grain refining a copper-based metal, and a grain refiner for use in that method. The inventors (hereinafter called the prior inventors) of the invention which is the subject of that application (hereinafter called the prior invention) are Professor Dr.-Ing W. Reif and Dipl.-Ing. G. Weber, both of the Institut fuer Metallforschung-Metallkunde, Technische Universitaet Berlin.

According to the prior invention, there is provided a method of grain refining a copper-based metal, the method comprising arranging that a melt of the metal to be grain refined contains each of the following components:

(a) titanium and/or zirconium;

(b) at least one of: lithium, sodium, potassium, beryllium, magnesium, calcium, strontium and barium;

(c) at least one of: scandium, yttrium, titanium, zirconium, hafnium, vanadium, niobium, tantalum, chromium, molybdenum, tungsten, manganese, technetium, rhenium, iron, ruthenium, osmium, cobalt, rhodium, iridium, nickel, palladium, platinum, silver, gold, zinc, cadmium, mercury and the rare earth elements; and (d) at least one of: aluminium, gallium, indium, silicon, germanium, tin, lead, phosphorus, arsenic, antimony, bismuth, sulphur, selenium and tellurium;

and solidifying the melt to produce grain refinement of the copper-based metal.

Neither we nor the prior inventors have so far been able to elucidate the precise mechanism by which the grain refinement brought about by the method of the prior invention occurs, but we do know that it involves the provision of some kind of nucleant particles for the copper-based metal melt as it solidifies.

The lists given above for components (a), (b), (c) and (d) have been drawn up as a result of a large number of tests carried out by the prior inventors. All of the elements listed have been tested, with the exception of scandium, yttrium, technetium, rhodium, hafnium, rhenium, osmium, mercury and the rare earth elements other than cerium in the list for component (c). Nevertheless, we believe that the latter untested elements are also fully effective as component (c) materials.

In all of the tests, the materials specified for components (a) to (d) were added as either the respective elements or as master alloys.

It will be seen that titanium and zirconium are both included both in the list for component (a) and in the list for component (c), and, for the avoidance of doubt, it is pointed out that it is not sufficient to select just one of titanium and zirconium to serve as both component (a) and component (c): however, where one of titanium and zirconium is selected as component (a), the other may be selected as component (c).

Preferably, component (a) includes zirconium, as it has been found to be more effective than titanium.

Component (b) preferably comprises at least one of: magnesium, calcium, strontium and barium, and most preferably comprises magnesium.

All of the elements tested in the list of component (c) materials have been found to be similar in their effectiveness. Iron is preferred from the point of view of cost, although in some cases it may be preferable to use one or more of the other possibilities, where the presence of iron in the grain refined metal would not be acceptable. Silver and tungsten have both been found to give slightly better results as component (c) than iron, but of course they are both more expensive than iron.

From the point of view of performance and cost, we prefer that component (d) should be one comprising phosphorous. However, we have found that, if component (d) comprises antimony and at least one of selenium and tellurium, grain refinement as good as that obtainable using phosphorus can be obtained. Component (d) can then be added as an antimony-based master alloy containing selenium, or as an antimony-based master alloy containing tellurium.

In accordance with a preferred embodiment of the prior invention, component (a) comprises zirconium; component (b) comprises at least one of: magnesium, calcium, strontium and barium; component (c) comprises iron; and component (d) comprises phosphorus.

It has been found that especially good results can be obtained if the melt of the metal to be grain refined, containing components (a) to (d), also contains at least a trace of carbon. This can conveniently be achieved by arranging that the said melt is contained in a vessel comprising a surface comprising graphite or other carbonaceous material, which surface is in contact with the melt. Of course, the carbonaceous material need not be present only at the respective surface; for example, the vessel may be made entirely of the carbonaceous material. Thus, it may, for example, be a silicon carbide type of crucible.

As a result of the tests which have been carried out, we believe that the optimum quantities of components (a) to (d) in the melt of the metal which is to be grain refined in accordance with the prior invention lie within the following ranges:

| | |
|---|---|
| (a) | 0.01 to 0.1 |
| (b) | 0.01 to 0.1 |
| (c) | 0.003 to 0.1 |
| (d) | 0.003 to 0.02 |

Copper-based metals which have been successfully grain refined by the method of the prior invention are:

1. Alpha-Beta-Brasses and Alpha-Brasses.

The brasses are copper-based alloys which contain zinc. Apart from the incidental impurities, they may also contain small proportions of one or more additional alloying components. Alpha-beta-brasses are brasses whose zinc content (between about 30 and 40 mass %) is such that both alpha and beta phases are present. By the same token, alpha brasses consist entirely of the alpha phase, and have a zinc content of up to about 30 mass %.

2. Bronzes.

The bronzes are copper-based alloys which contain tin. The following bronzes, in particular, have been successfully grain refined by the method of the invention.

2A. Tin Bronzes.

These are copper-based alloys which substantially consist of copper, tin and incidental impurities.

2B. Leaded Bronzes.

These are bronzes which are used for bearings, and generally comprise, in mass %, 5–10 tin, 5–30 lead, balance copper and incidental impurities.

3. Gunmetals.

These are copper-based alloys containing tin (generally 5 to 10 mass %) and zinc (generally 2 to 5 mass %). In addition to the incidental impurities, other elements, such as lead and/or nickel, for example, may be present.

In accordance with the prior invention, one or more of components (a) to (d) is conveniently added as a master alloy. It is preferable for the master alloy(s) used to be copper-based, where possible, although it (or they) may instead be based on another metal, such as aluminium for example, where the presence of that other metal in the grain refined alloy is acceptable. In cases where the final, grain refined alloy is required to contain one or more additional constituents, at least one of components (a) to (d) may be added by means of a master alloy which is based on, or at least contains, one or more such other constituent.

In practising the prior invention, it will often be found convenient to add each of components (a) to (d) by means of a different master alloy.

Alternatively, it will often be convenient to add components (a) to (d) as a single master alloy. In a preferred embodiment of the prior invention using this arrangement, components (a) to (d) are added as a copper-based master alloy comprising: (a) zirconium; (b) at least one of: magnesium, calcium, strontium and barium; (c) iron; and (d) phosphorus.

For further details of the prior invention, the reader is referred to the specification of UK patent application No. 8521134.

According to the present invention, there is provided a method of grain refining a copper-based metal, which method is a development of the method of the prior invention, as defined above, in that, in accordance with the present invention, at least one of components (a) to (d) is introduced into the melt by means of a powder which comprises one or more of the components (a) to (d).

We have discovered, surprisingly, that it is possible, adding one or more of components (a) to (d) to the melt by means of a powder in accordance with the present invention, to achieve grain refinement results which are almost as good as those obtainable with the prior invention, using the more conventional forms of grain refiner master alloys. This is surprising, because with all prior work of which we are aware on grain refinement of metals using a grain refiner in powder form, the results obtained have been substantially inferior to those obtainable using bulk master alloys. Thus, for example, the modern practice in grain refining aluminium-based metals is to introduce, into a melt of the alloy to be grain refined, aluminium-titanium-boron or aluminium-titanium master alloys in bulk (rod or waffle plate) form, and no particulate form of grain refiner has ever been able to approach the performance of these bulk forms of grain refiners. The amount of aluminium which is grain refined nowadays is much greater than the amounts of other metals given grain refinement treatment, but with those other metals too, particulate forms of grain refiner have not been able to approach the performance obtainable with the best of the bulk forms of grain refiners.

We have found that generally all of the features which can be employed in putting the prior invention into practice are, mutatis mutandis, applicable to the present invention, when due allowance is made for the powder nature of such of components (a) to (d) that are introduced into the melt in powder form.

In particular, the present invention can be employed to grain refine the following types of copper-based metal: brass (alpha as well as alpha-beta); bronze (tin bronze as well as leaded bronze); and gunmetal.

As a result of the tests which have been carried out so far, we believe that, with the present invention, the optimum quantities of components (a) to (d) in the melt of the metal which is to be grain refined lie within the following ranges:

| Component | Amount, in mass % |
|---|---|
| (a) | 0.01 to 0.1 |
| (b) | 0.01 to 0.1 |
| (c) | 0.003 to 0.1 |
| (d) | 0.001 to 0.02 |

These ranges coincide with those given above in respect of the prior invention, except for the lower limit for the preferred range for component (d) in the present invention.

The considerations disclosed in relation to the prior invention regarding the choice of components (a), (b), (c) and (d) generally apply to the present invention also. Thus, for example, we prefer that component (a) comprises zirconium; that component (b) comprises at least one of: magnesium, calcium, strontium and barium; that component (c) comprises iron; and that component (d) comprises phosphorus.

Our tests on the forms of components (a) to (d) for use in the present invention have shown the following forms to be particularly desirable:

for component (a), a powder comprising particles of a copper-based alloy comprising zirconium;

for component (b), a powder comprising particles of a magnesium-based metal;

for component (c), a powder comprising particles of an iron-based metal; and for component (d), a powder comprising particles of a copper-based alloy comprising phosphorus.

It may be desirable, on some occasions, for two or more of components (a), (b), (c) and (d) to be present together in a single alloy. For example, the list of forms given in the preceding paragraph could be modified by using, for components (b) and (c), a powder comprising particles of a copper-based alloy comprising both magnesium and iron.

In most cases, it will be found most convenient, when practising the present invention, to introduce all of components (a) to (d) into the melt by means of a powder comprising components (a), (b), (c) and (d). Grain refinement can then be achieved through the addition of a single additive. However, in some cases, the melt may already contain sufficient of one or some of these components, so that grain refinement can then be achieved through the addition of a single additive comprising only some of components (a), (b) (c) and (d). Also, in some situations, it may be found better to add at least one of these components separately from the rest; for example, where the melt already contains an amount of a given component which is less than that needed for the grain refinement required but which varies from batch to batch, and it is desired to avoid introducing more of that component than is necessary, then fine tuning of the content of that component can probably best be achieved by introducing that component separately.

For the avoidance of doubt, it is pointed out that the term "powder" as used herein means a particulate material, the particles of which are not necessarily free-flowing, or even capable, under normal conditions, of any relative movement. The particle size of the powder may be as great as 1000 microns down (i.e. capable of passing through a sieve having 1000 microns diameter openings), or even larger. However, the particle size of suitable powders will normally be at most 500 microns down, and at present we prefer that the particle size is at most 150 microns down.

In accordance with the present invention, the powder or powders for introducing the respective component(s) can be in any one or more of the following forms, for example:

1. As a cored wire, i.e. as an elongate tubular member enclosing the respective powder(s). The material of the tubular member would normally be such that, on feeding the cored wire into the melt of the metal which is to be grain refined, it melts, to release the powder into the melt. It should also be non-deleterious towards the melt. In many cases, a suitable material for the tubular member would be a copper-based metal, such as copper itself, for example.
2. As free-running powder(s) contained within foil. The considerations concerning the choice of material for the foil are similar to those given above in relation to the material for the tubular member of a cored wire, and again the material may be, for example, a copper-based metal e.g. copper. Metering of the respective powder can be facilitated by using foil packages of predetermined powder content weight.
3. As free-running powder(s) applied, within a mould and/or one or more conduits leading to the mould, prior to casting of the melt. The grain refiner material used in this method is particularly inexpensive to produce.
4. By injecting a suspension of the powder(s) in a carrier gas such as argon, for example, into the melt. Again, the grain refiner material used is inexpensive to produce, and this method lends itself to accurate control of the rate of grain refiner addition.
5. As a briquetted powder.

Method no. 5 is the most preferred one. Preferably, the briquetted powder is free of binder and lubricant. We prefer that the briquetted powder should be in the form of briquettes of substantially equal weight: this facilitates accurate addition of the respective powder(s) to the melt.

The present invention also comprehends a grain refiner for grain refining a copper-based metal, as defined in the appended claims relating to grain refiners.

An especially preferred grain refiner in accordance with the invention is one in the form of a binder- and lubricant-free briquetted powder mixture comprising the following components, in mass %:

7 to 15% zirconium;
3 to 10% magnesium;
1 to 5% iron; and
0.3 to 3% phosphorus, the zirconium being present as a powder of a copper-based alloy comprising zirconium, the magnesium being present as a powder of a magnesium-based metal, the iron being present as a powder of an iron-based metal, and the phosphorus being present as a powder of a copper-based alloy comprising phosphorus.

The present invention, making use as it does of grain refining materials in powder form, has substantial advantages. In particular, grain refining materials in this form are generally significantly cheaper to produce than the forms of high performance grain refiners at present in use. This is due not only to the lower energy requirements involved in production, but also to the fact that many of the powder materials required are available as "fines" which would otherwise be regarded as waste products. In addition, as indicated above, it is generally easier to meter the addition of grain refining materials in powder form, especially when the powder is in briquette form. Furthermore, in multi-component grain refiners in powder form, it is easy to achieve any required ratio of the individual components, whereas with master alloy grain refiners in rod or waffle plate form, for example, one is for practical purposes precluded from using large ranges of component ratios, because of constraints by the respective phase diagrams. Indeed, many combinations of components are for this reason not possible at all with the latter forms, and in such cases the invention provides a means of using the desired components, in any desired ratio.

Figure 2:
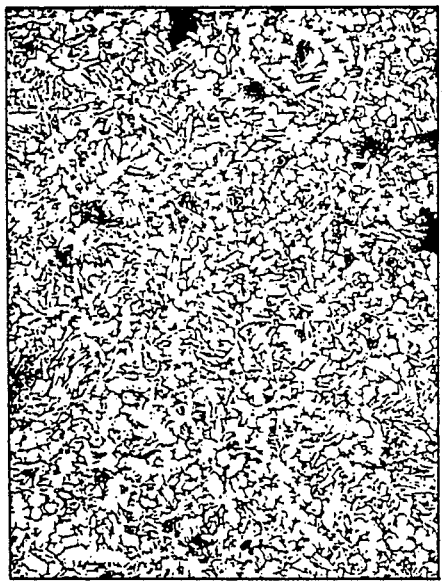
Figure 3:
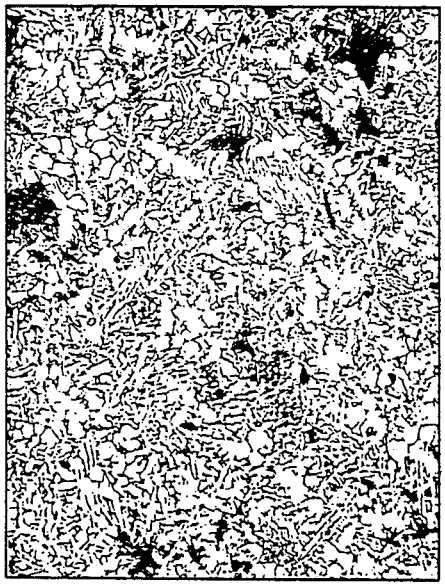
Figure 4:
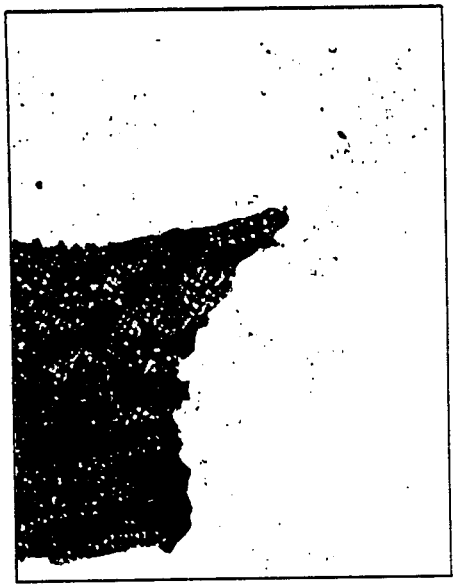
Figure 5:
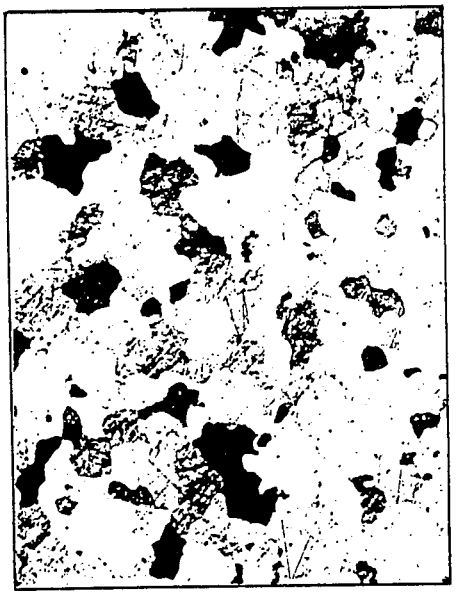

In order that the invention may be more fully understood, some embodiments in accordance therewith will now be described, in the following Examples, with reference to the accompanying drawings, wherein:

FIGS. 1 to 3 show optical micrographs, all at a magnification of 50:1, of an alpha-beta-brass alloy, CuZn40, respectively un-grain refined, grain refined in accordance with the invention, and grain refined in accordance with the method of the prior invention; and FIGS. 4 and 5 show optical micrographs, both at a magnification of 50:1, of an alpha brass, CuZn30, respectively un-grain refined, and grain refined in accordance with the invention.

EXAMPLE 1

Alpha-Beta-Brass

Grain refiner briquettes in accordance with the invention were produced as follows. A copper—26 mass % zirconium alloy was crushed and milled to <250 microns, with a minimum of fines (in this context <75 microns), and the same procedure was applied to a copper—15 mass % phosphorus alloy. These two powders were intimately mixed with iron, magnesium and electrolytic copper powders of comparable size distribution, in proportions such as to produce a mixed powder containing the following components, in mass %:

| | |
|---|---|
| zirconium | 10.2% |
| magnesium | 6.1% |
| iron | 1.96% |
| phosphorus | 0.72% |
| copper | balance |

No binders or lubricants were added. This powder mixture was then tabletted into briquettes 40 g in weight, of approximate dimensions 31 mm diameter×10 mm thick. Two briquetted tablets were then added to a 15 kg melt of an alpha-beta brass, copper—40 mass % zinc. This was an additive addition rate of 0.5%, giving the following concentrations, in mass %, of components (a) to (d) in the treated melt:

| | |
|---|---|
| Zirconium | 0.054% |

-continued

| | |
|---|---|
| Magnesium | 0.03% |
| Iron | 0.01% |
| Phosphorus | 0.0038% |

The addition was accomplished by placing the tablets in an open-ended graphite plunging bell, covering the end of the bell with a pre-heated sample spoon, and plunging both spoon and bell to the bottom of the melt. The tablets reacted and dissolved within a few seconds, whereupon the spoon was withdrawn and the melt stirred vigorously with the plunger. A sample was taken and poured into a cylindrical graphite mould 150 mm in diameter×150 mm high, and having a cylindrical mould cavity 140 mm in diameter×70 mm high, the sample being allowed to cool down to ambient temperature.

Next, a blank test was run, by repeating the above described test, but without making any grain refining addition.

The test was again repeated, this time adding a grain refiner in accordance with the prior invention, consisting of a bulk master alloy which had been prepared by a melt procedure, to produce an alloy of similar composition to the overall composition of the above-described briquettes, the amount of master alloy added being such as to provide substantially the same concentrations of zirconium, magnesium, iron and phosphorus in the treated melt.

In each case, the solidified sample was sectioned, polished and examined. FIGS. 1 to 3 show, respectively, the blank, the sample treated in accordance with the present invention, and that treated in accordance with the prior invention, the average grain sizes being respectively 652 microns, 106 microns and 105 microns.

EXAMPLE 2

Alpha-Brass

Example 1 was repeated, but this time the melt was an alpha-brass, copper—30 mass % zinc. The solidified brass samples were sectioned and polished, the average grain sizes being 1397 microns for the blank, 132 microns for the brass treated in accordance with the present invention, and 58 microns for the brass treated in accordance with the prior invention.

FIGS. 4 and 5 show, respectively, the blank and the sample treated in accordance with the present invention.

We claim:

1. A method of grain refining a copper-based metal, the method comprising preparing a melt of copper-based metal to be grain refined which is deficient in at least one of the following components (a) to (d), said components (a) to (d) comprising:

(a) at least one of titanium and zirconium;

(b) at least one of: lithium, sodium, potassium, beryllium, magnesium, calcium, strontium and barium;

(c) at least one of: scandium, yttrium, titanium when said component (a) is zirconium, zirconium when said component (a) is titanium, hafnium, vanadium, niobium, tantalum, chromium, molybdenum, tungsten, manganese, technetium, rhenium, iron, ruthenium, osmium, cobalt, rhodium, iridium, nickel, palladium, platinum, silver, gold, zinc, cadmium, mercury and the rare earth elements; and (d) at least one of: aluminium, gallium, indium, silicon, germanium, tin, lead, phosphorus, arsenic, antimony, bismuth, sulphur, selenium and tellurium;

introducing said deficient component (a) to (d) into said melt of copper-based metal by means of a powder which contains at least one of said components (a) to (d) including said deficient component, and thereafter solidifying said melt of copper-based metal which now contains each of said components (a) to (d) to produce grain refined copper-based metal.

2. A method according to claim 1, wherein component (a) comprises zirconium; component (b) comprises at least one of: magnesium, calcium, strontium and barium; component (c) comprises iron; and component (d) comprises phosphorus.

3. A method according to claim 1, wherein the amount of component (a) contained in the melt of the metal which is to be grain refined is 0.01 to 0.1 mass %, the amount of component (b) contained in the melt of the metal which is to be grain refined is 0.01 to 0.1 mass %, the amount of component (c) contained in the melt of the metal which is to be grain refined is 0.003 to 0.1 mass %, and the amount of component (d) contained in the melt of the metal which is to be grain refined is 0.001 to 0.02 mass %.

4. A method according to claim 1, wherein component (a) is introduced into the melt by means of a powder comprising particles of a copper-based alloy comprising zirconium.

5. A method according to claim 1, wherein component (b) is introduced into the melt by means of a powder comprising particles of a magnesium-based metal.

6. A method according to claim 1, wherein component (c) is introduced into the melt by means of a powder comprising particles of an iron-based metal.

7. A method according to claim 1, wherein component (d) is introduced into the melt by means of a powder comprising particles of a copper-based alloy comprising phosphorus.

8. A method according to claim 1, wherein components (a) to (d) are introduced into the melt by means of a powder comprising components (a), (b), (c) and (d).

9. A method according to claim 1, wherein the copper-based metal which is grain refined is an alpha-brass or an alpha-beta-brass.

10. A method according to claim 1, wherein the copper-based metal which is grain refined is a bronze.

11. A method according to claim 1, wherein the copper-based metal which is grain refined is a gunmetal.

12. A method according to claim 1, wherein at least one powder used for introducing the respective component(s) into the melt is introduced as a cored wire.

13. A method according to claim 1, wherein at least one powder used for introducing the respective component(s) into the melt is introduced as a free-running powder contained within foil.

14. A method according to claim 1, wherein at least one powder used for introducing the respective component(s) into the melt is introduced by injecting a suspension of the powder in a carrier gas into the melt.

15. A method according to claim 1, wherein at least one powder used for introducing the respective component(s) into the melt is introduced as a briquetted powder.

16. A method according to claim 15, wherein the briquetted powder is free of binder and lubricant.

17. A method according to claim 15, wherein the briquetted powder is in the form of briquettes of substantially equal weight.

18. A grain refiner for grain refining a copper-based metal, and comprising a powder containing each of the following components:

(a) at least one of titanium and zirconium;

(b) at least one of: lithium, sodium, potassium, beryllium, magnesium, calcium, strontium and barium;

(c) at least one of: scandium, yttrium, titanium when said component (a) is zirconium, zirconium when said component (a) is titanium, hafnium, vanadium, niobium, tantalum, chromium, molybdenum, tungsten, manganese, technetium, rhenium, iron, ruthenium, osmium, cobalt, rhodium, iridium, nickel, palladium, platinum, silver, gold, zinc, cadmium, mercury and the rare earth elements; and (d) at least one of: aluminium, gallium, indium, silicon, germanium, tin, lead, phosphorus, arsenic, antimony, bismuth, sulphur, selenium and tellurium.

19. A grain refiner according to claim 18, wherein component (a) comprises zirconium; component (b) comprises at least one of: magnesium, calcium, strontium and barium; component (c) comprises iron; and component (d) comprises phosphorus.

20. A grain refiner according to claim 18, wherein component (a) is present as a powder comprising particles of a copper-based alloy comprising zirconium.

21. A grain refiner according to claim 18, wherein component (b) is present as a powder comprising particles of a magnesium-based metal.

22. A grain refiner according to claim 18, wherein component (c) is present as a powder comprising particles of an iron-based metal.

23. A grain refiner according to claim 18, wherein component (d) is present as a powder comprising particles of a copper-based alloy comprising phosphorus.

24. A grain refiner according to claim 18, when in the form of a cored wire.

25. A grain refiner according to claim 18, when in the form a free-running powder contained within foil.

26. A grain refiner according to claim 18, when in the form of a free-flowing powder suitable to be injected with a carrier gas into a melt of a copper-based metal which is to be grain refined.

27. A grain refiner according to claim 18, when in the form of a briquetted powder.

28. A grain refiner according to claim 27, wherein the briquetted powder is free of binder and lubricant.

29. A grain refiner according to claim 27, wherein the briquetted powder is in the form of briquettes of substantially equal weight.

30. A grain refiner according to claim 18, in the form of a binder- and lubricant-free briquetted powder mixture comprising the following components, in weight %:

7 to 15% zirconium;
3 to 10% magnesium;
1 to 5% iron; and
0.3 to 3% phosphorus, the zirconium being present as a powder of a copper-based alloy comprising zirconium, the magnesium being present as a powder of a magnesium-based metal, the iron being present as a powder of an iron-based metal, and the phosphorus being present as a powder of a copper-based alloy comprising phosphorus.

* * * * *